United States Patent [19]

Fuchs

[11] 3,953,090

[45] Apr. 27, 1976

[54] MEMORANDUM SHEET DISPENSER

[76] Inventor: Hans Fuchs, Deweerthstrasse 98, 56 Wuppertal 1, Germany

[22] Filed: May 27, 1975

[21] Appl. No.: 580,740

[30] Foreign Application Priority Data

June 5, 1974 Germany ..... 2427203

[52] U.S. Cl. ..... 312/183; 206/74; 40/156; 221/279; 312/61; 312/190

[51] Int. Cl.[2] ..... B42F 17/00

[58] Field of Search ..... 221/56–60, 221/52, 279, 280, 27, 28, 312; 206/73, 74; 312/180, 184, 189, 190, 191, 61, 71, 183; 40/156, 157, 312

[56] References Cited

UNITED STATES PATENTS

| | | | |
|---|---|---|---|
| 2,630,219 | 3/1953 | Pierce | 206/74 |
| 2,776,743 | 1/1957 | Treiss | 221/58 |
| 2,834,130 | 5/1958 | Nelson | 40/312 |
| 3,291,339 | 12/1966 | Hein | 221/52 |

FOREIGN PATENTS OR APPLICATIONS

| | | | |
|---|---|---|---|
| 615,576 | 8/1934 | Germany | 221/59 |

*Primary Examiner*—Stanley H. Tollberg
*Attorney, Agent, or Firm*—Abraham A. Saffitz

[57] ABSTRACT

An open top rectangular box sheet dispensing device fitted with spring follower for housing individual and separate memorandum sheets which are stacked within the device and are confined at the top sheet and at the rear wall surface by retaining elements located at the top and rear corners of the box housing to overlap the top of the stacked sheets. The sheets are each formed with recessed portions at each side of the sheet adjacent the back edge which fits under the retaining elements of open box dispenser and the box dispenser is provided with vertical guiding elements which fit into these recesses to maintain the sides of the sheets within proper alignment, thereby adapting easy filling of the dispenser while permitting writing over the entire sheet.

5 Claims, 9 Drawing Figures

MEMORANDUM SHEET DISPENSER

BACKGROUND OF THE INVENTION

1. Field of the Invention

The invention relates generally to the field of rectangular box shaped dispensing devices for sheet articles in stacked relation in which the dispensing device is fitted with a spring follower over which the stacked sheets rest and which urges the stacked sheets toward the dispensing opening at the top of the box shaped housing. The invention also generally relates to special holding or retaining means at the top of the dispensing opening adapting the sheets to serve as memorandum sheets upon which notes may be written and easily removed and further relates to a modified form of memorandum sheet adapted to be aligned within the box dispenser by vertical guiding members adjacent the special retaining means at the top and at the rear edge of the box dispenser with open top.

2. Description of the Prior Art

In the case of the known dispensers for memorandum sheets, only the uppermost memorandum sheet of the stack of memorandum sheets located in the receiving housing can be written on and pulled out from the dispensing housing. As compared to these dispensers, a stitched memorandum book offers the advantage that the sheets can be opened up and that one can make entries on any desired pages. However, it is true that memorandum books are not suitable as memorandum sheet dispensers. It is also true that while one can separate individual pages from the memorandum book and thereafter refill the dispenser, the stitched memorandum book cannot be refilled again with new sheets.

Hein, U.S. Pat. No. 3,291,339, shows a paper sheet dispenser of box shape fitted with a spring follower urging the sheets against flange members at the top cover of the dispenser. When a sheet is required to be dispensed, the upper surface of the uppermost sheet is grasped by the hand so as to bend transversely which causes one or both of the upper and lower edge portions thereof to withdraw inwardly from beneath the flange members.

Liben, U.S. Pat. No. 2,456,068, shows a dispenser for paper napkins which provides a spring loaded follower plate urging the stack of napkins towards the dispensing opening. The follower plate is angulated towards the front to compress the part of the stack away from the dispensing opening and thereby facilitating separation of the napkins at the opening.

The present invention differs from these prior art dispensing devices in being almost entirely open at the top and in having the separate sheets modified at the sides near the rear edge with recesses engaging vertical guide elements in the box dispenser and further in providing corner retainers at the sides and the rear edge to retain the stack at the top sheet while permitting easy removal as a memorandum sheet.

OBJECTS OF THE INVENTION

It is an object of the invention to provide a memorandum sheet dispenser of open top construction in which at least the upper part of the inserted stack of memorandum sheets can be opened up in the manner of a stitched memorandum book, so that many memorandum sheets are still held in the memorandum sheet dispenser and the sheets can be written upon.

It is a further object to provide a memorandum sheet dispenser in which one is able to pull out any desired memorandum sheet lying deeper in the stack without loosening or undoing any of the sheets lying above it.

It is a further object to provide a simple and easy refilling of the memorandum sheet stack in which the sheets are aligned as a result of the cooperation between recesses in the sheet and guiding elements in the dispenser.

Starting out from a memorandum sheet dispenser of the above-mentioned type, it is a further object of the invention to provide closing or retaining elements only in the rear of the receiving housing and that below the closing elements yet close to these, and on both sides of the housing elongated downward by extending guide elements are disposed, which engage in recesses provided on the lateral edges of the memorandum sheets. Effectively, the level of filling of the housing is greater than the length of these guiding elements.

SUMMARY OF THE INVENTION

The invention relates to a memorandum sheet dispenser which consists of a box-shaped receiving housing with open top for loose memorandum sheets in which the upper rear edge of the housing has closing elements at the corners projecting partly beyond the inserted memorandum sheets, and a helical follower spring disposed in the housing and pressing upwardly against the stack of memorandum sheets until they fit snugly against the closing elements.

In the case of the memorandum sheet dispenser according to the invention, the retaining or closing elements overreach the sheets almost exclusively within the range of an edge of the housing immediately adjacent the rear edge of the memorandum sheets so that almost the entire surface of each of the sheets in the stack is open for being written upon and so that the stack of memorandum sheets can be opened up from the front in a sheet by sheet manner on the front side of the dispenser. Guiding elements in the form of pegs are provided at both sides of the stack of memorandum sheets, which in turn are provided with lateral recesses to fit the pegs and to prevent any unintended loosening or undoing of sheets in the stack. Any desired memorandum sheet, which is to be opened up, can be grasped and pulled out from the stack past the guide elements, whereby the rear corners of the pertinent memorandum sheet are forced somewhat inwardly by the vertical pegs which serve as guide elements, while all other sheets remain hooked firmly to these guide elements.

The refilling of the memorandum sheet dispenser can be accomplished in a simple manner based on the fact that a new stack of memorandum sheets is placed as a unit onto the housing and is pressed downwards while forcing it past the relatively small corner closing elements, until these closing elements again overlap the uppermost sheet of the stack of memorandum sheets. The sheets in the upper part of the newly inserted stack at the same time are then bound at the sides automatically by the pegs or guide elements. This refilling can be accomplished quickly with only one hand.

In the preferred embodiment of the invention, the closing elements consist of two small corner pieces stretched and formed over the rear corners of the housing so as to overlap only the rear corners of the memorandum sheets. The guide elements may consist of ribs formed on to the lateral walls of the housing, but according to the preferred embodiment, the guide elements consist of pegs placed below the connecting elements. In this case effective provision will be made, that the guide pegs maintain a distance from the adjacent housing walls that the housing consists of a plastic as clear as glass and that its four vertical walls can be covered on the inside with a band, which can be inserted between the housing walls and the guiding pegs. The four sides of the housing are thus available as advertising surfaces for advertising purposes.

BRIEF DESCRIPTION OF THE DRAWINGS

The object of the invention will be explained in greater detail in the following description and on the basis of the drawings.

DESCRIPTION OF THE PREFERRED EMBODIMENTS

Figure 1:
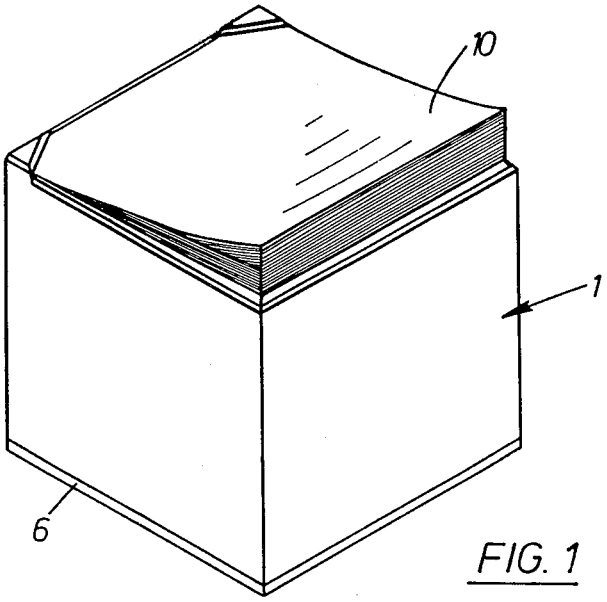
FIG. 1 shows a perspective view of a memorandum sheet dispenser according to the invention.
Figure 6:
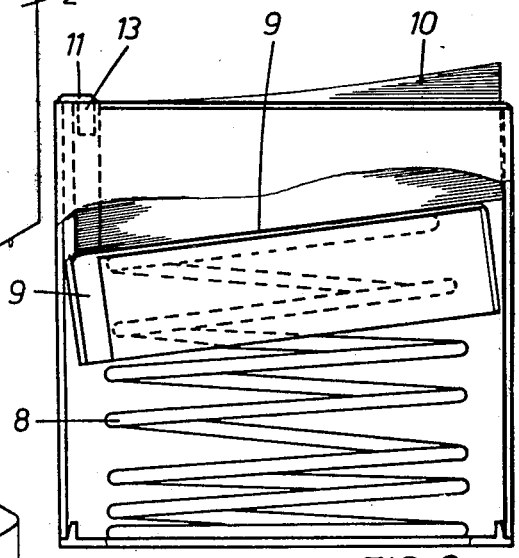
FIG. 6 shows the memorandum sheet dispenser according to FIG. 1 in a vertical section.
Figure 5:
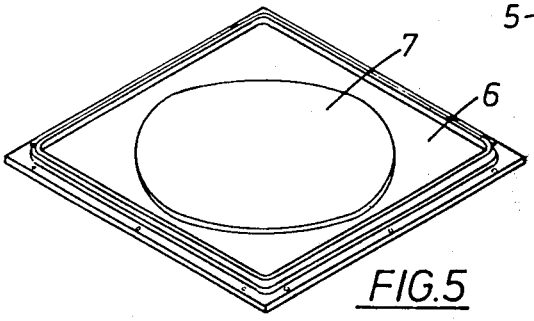

As shown in FIG. 1, the memorandum sheet dispenser consists of a rectangular box shaped receiving housing 1 provided with a front wall 2, side walls 3 and 4, and a rear wall 5. The housing 1 is closed from below by means of a lid 6 (see FIGS. 1 and 5), and on the inside surface of lid 6 there is a disc 7, which has been formed on the lid 6 and secured thereto in order to serve as a guiding core for the lower end of a helical spring 8 as shown in FIG. 6 and which serves as the follower spring for the memorandum stack. The helical spring 8 carries a cap 9 which is guided within the housing 1 and which together with the cap forms the yielding base for the stack 10 of memorandum sheets which are inserted from above in the housing.

At each of the rear corners of the housing between the rear wall 5 and the two lateral walls 3 and 4, there is provided a retainer means for the stack in the form of closing pieces 11 and 12 at the corners adjacent walls 3 and 4, respectively. The closing pieces 11 and 12 are triangular in shape and overly the top edges at the corners of walls 3 and 4 to retain the stack of 10 of memorandum sheets 15 which are pressed upwardly against these pieces 11 and 12 by the spring action helical spring 8 and cap 9 underlying the stack.

Figure 2:
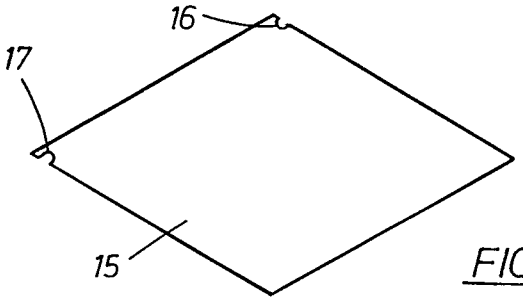
FIG. 2 is a perspective view of a memorandum sheet which is one of a stack of sheets in the dispenser.
Figure 3:
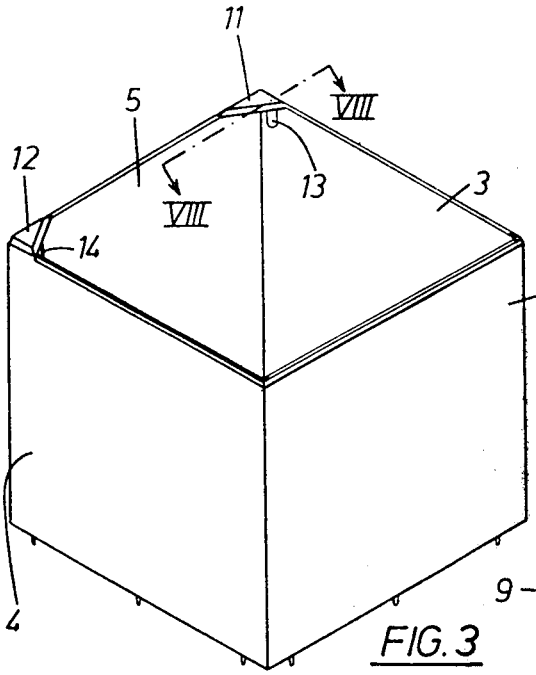
FIGS. 3, 4 and 5 show a perspective view of top middle and lower parts of the memorandum sheet dispenser according to FIG. 1.

Guiding means 13 and 14 are provided below these closing triangular pieces 11 and 12 and extend vertically along the sides 3 and 4, respectively, these guiding means being preferably in the form of pegs which engage recesses 16 and 17, respectively, at each side of the memorandum sheet (see FIG. 2) whereby the sheets 15 are each properly aligned in the stack.

As is seen in FIGS. 1 and 6, the stack 10 of memorandum sheets, the front and sides of the sheet are easily accessible for writing notes and the front serves as the access side for using the device as a memorandum pad, so that substantially all of the memorandum sheets at the front extend beyond the edge of the housing for easy removal. The level of filling of the stack which may be taken as the maximum distance between the top side of the cap 9 and the closing pieces 11 and 12, and as is evident from the illustration in FIGS. 1 and 6, this level is considerably larger than the height of the guiding means, pegs, 13 and 14. In the preferred embodiment as shown in FIG. 4, guiding means, pegs, 13 and 14 are mounted in lateral grooves 18 and 19.

Figure 4:
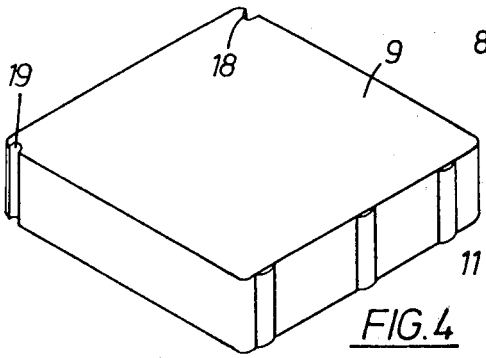

As shown in FIG. 4, cap 9 is provided with lateral grooves 18 and 19 to accommodate guiding means, pegs, 13 and 14, and as the stack decreases in height due to taking off sheets therefrom, the level of the stack is reduced to a length which equals the length of the guiding means, pegs, 13 and 14.

Figure 7:
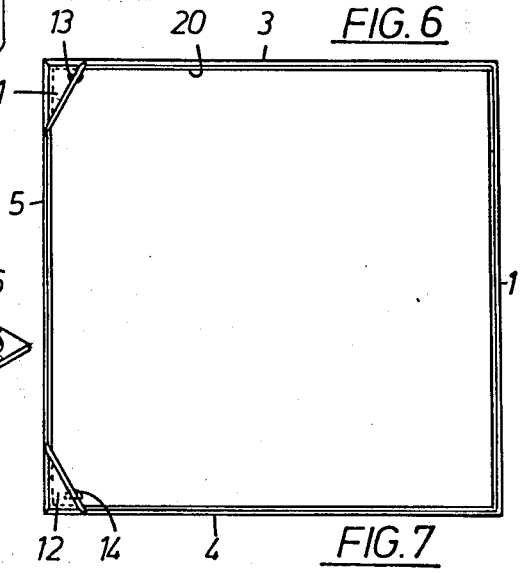
FIG. 7 shows the memorandum sheet dispenser of FIG. 1 in a top view.

In an embodiment of the invention adapted for advertising and as illustrated in FIG. 7, the housing 1 of the sheet dispenser is formed of transparent plastic which is as clear optically as is glass and in this form all four sides of the box-like housing serve for advertising purposes. In order to provide a pointed message, which may be changed from time to time, a band 20, as shown in FIG. 7, is inserted and folded within the inner walls of the box-like housing 1, and the printed message may be changed by replacing the band with another band. In this manner, there are provided four fields for advertising, one field at each side and the band can be inserted before inserting the stack of memorandum sheets.

In this connection, it should be noted that the guiding means, pegs, 13 and 14 have their front ends anchored onto the upper corner closing pieces 11 and 12 with a space or gap between the guiding means, pegs, 13 and 14 and the respective side walls 3 and 4, thereby providing spacing for the insertion of the cardboard advertising band 20.

Figure 9:
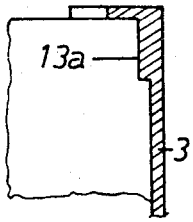
FIG. 9 is a sectional view of a modified embodiment in a corner showing analogous to the view of the embodiment according to FIG. 8.
Figure 8:
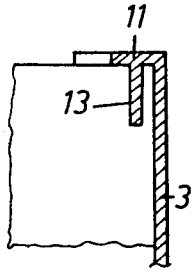
FIG. 8 shows a sectional view following the line VIII — VIII in FIG. 3.

In FIG. 9, there is illustrated a modification of the invention in which the guiding elements do not take the form of guiding means, pegs, 13 and 14 as in FIGS. 1 – 8, but instead consist of ribs, which are integral with and formed directly as part of the side wall structure of side walls 3 and 4. In a plastic box-like construction as illustrated in this FIG., the side pieces may be formed with integral ribs by injection molding. Obviously, in this form of the invention, the advertising band 20 may not be inserted, and this form, therefore, can be made of transparent or of opaque plastic material.

Having thus described the invention, what is claimed is:

1. A rectangular memorandum sheet dispenser adapted to house individual and separate rectangular memorandum sheets stacked in the dispenser, in which at least the upper part of the inserted stack of memorandum sheets can be opened up in the manner of a stitched memorandum book, so that many memorandum sheets are still held in the memorandum sheet dispenser and the sheets can be written upon, comprising:

an open top, rectangular box-shaped housing having a bottom, a front wall, two sides, and a rear wall;

a triangular shaped closing means at the rear and side walls spanning each rear corner to retain a stack of memorandum sheets at the rear corners and at the top of said stack to expose the major part of the sheet of the stack at the top;

a helical spring fitted under the stack to press said stack upwardly against said closing means at the top of said housing;

elongated guiding elements directly below and integral with said closing means and adjacent said side walls of said housing, said guiding elements extending downwardly in said housing a short distance to align the sheets in the stack which are recessed in a shape corresponding to the cross section of said guiding elements, whereby the upward movement of said stack follows the recess by the engagement of said guiding elements near the top of the stack; and, said memorandum sheets of said stack each being provided with guiding recesses adjacent the rear edge thereof and at each side for engagement with said guiding means whereby one is able to pull out any desired memorandum sheet lying deeper in the stack without loosening or undoing any of the sheets lying above it.

2. A sheet dispenser as claimed in claim 1 wherein a fresh stack of said memorandum sheets has a depth which is greater than the length of said elongated guiding elements.

3. A sheet dispenser as claimed in claim 1 wherein said guiding elements are in the form of pegs which are spaced from said side walls and said rear wall and secured to the underside of said closing means adapting the dispenser for insertion of advertising material.

4. A sheet dispenser as claimed in claim 3 wherein said housing is formed of transparent clear plastic and a band printed with advertising indicia is inserted between said guiding means and below said closing means within the transparent four walls of said housing.

5. A sheet dispenser as claimed in claim 1 wherein the top of said helical spring is fitted with a cap which urges said stack in normal relation against said closing means and the bottom of said housing is fitted with a disc for receiving the bottom of said spring.

* * * * *